US012644354B2

(12) United States Patent
Pirayeh Gar et al.

(10) Patent No.: US 12,644,354 B2
(45) Date of Patent: Jun. 2, 2026

(54) PACKER BACK-UP SHOE

(71) Applicant: HALLIBURTON ENERGY SERVICES, INC., Houston, TX (US)

(72) Inventors: Shobeir Pirayeh Gar, Plano, TX (US); Frank Vinicia Acosta Villarreal, Houston, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 25 days.

(21) Appl. No.: 18/400,494

(22) Filed: Dec. 29, 2023

(65) Prior Publication Data

US 2025/0215763 A1 Jul. 3, 2025

(51) Int. Cl.
*E21B 33/12* (2006.01)
*E21B 33/128* (2006.01)

(52) U.S. Cl.
CPC ..... *E21B 33/1216* (2013.01); *E21B 33/128* (2013.01)

(58) Field of Classification Search
CPC ..... E21B 33/128; E21B 33/1216
See application file for complete search history.

(56) References Cited

U.S. PATENT DOCUMENTS

| | | | | |
|---|---|---|---|---|
| 3,789,926 | A | 2/1974 | Henley et al. | |
| 3,948,322 | A | 4/1976 | Baker | |
| 4,487,263 | A | 12/1984 | Jani | |
| 4,674,569 | A | 6/1987 | Revils et al. | |
| 4,730,835 | A * | 3/1988 | Wilcox | E21B 33/1216 166/134 |
| 5,024,273 | A | 6/1991 | Coone et al. | |
| 5,279,370 | A | 1/1994 | Brandell et al. | |
| 5,411,095 | A | 5/1995 | Ehlinger et al. | |
| 5,443,124 | A | 8/1995 | Wood et al. | |
| 5,647,434 | A | 7/1997 | Sullaway et al. | |
| 5,765,641 | A | 6/1998 | Shy et al. | |
| 6,026,903 | A | 2/2000 | Shy et al. | |
| 6,244,342 | B1 | 6/2001 | Sullaway et al. | |
| 6,425,442 | B1 | 7/2002 | Latiolais, Jr et al. | |
| 6,796,377 | B2 | 9/2004 | Butterfield, Jr. et al. | |
| 6,802,373 | B2 | 10/2004 | Dillenbeck et al. | |
| 7,237,611 | B2 | 7/2007 | Vincent et al. | |
| 7,857,052 | B2 | 12/2010 | Giroux et al. | |
| 7,866,402 | B2 | 1/2011 | Williamson, Jr. | |
| 8,215,404 | B2 | 7/2012 | Makowiecki et al. | |

(Continued)

FOREIGN PATENT DOCUMENTS

EP 1262629 A1 12/2002

OTHER PUBLICATIONS

International Search Report and Written Opinion dated Sep. 26, 2024, issued in corresponding PCT Application No. PCT/US2024/010250.

(Continued)

*Primary Examiner* — D. Andrews
(74) *Attorney, Agent, or Firm* — McAfee & Taft

(57) ABSTRACT

A support shoe for a sealing element of a packer assembly has a support shoe arm extending longitudinally over an outer surface of the sealing element. A support shoe leg extends beneath the sealing element and the top of a ramped surface of a setting sleeve. A connecting portion connects the support shoe arm and the support shoe leg, and the support shoe envelops an upper end of the sealing element.

16 Claims, 6 Drawing Sheets

(56) References Cited

U.S. PATENT DOCUMENTS

| | | | | |
|---|---|---|---|---|
| 8,616,276 | B2 | 12/2013 | Tips et al. | |
| 8,646,537 | B2 | 2/2014 | Tips et al. | |
| 8,720,561 | B2 | 5/2014 | Zhou | |
| 9,010,442 | B2 | 4/2015 | Streich et al. | |
| 9,121,255 | B2 | 9/2015 | Themig et al. | |
| 9,291,007 | B2 | 3/2016 | Darbe et al. | |
| 9,441,440 | B2 | 9/2016 | Hofman et al. | |
| 9,441,446 | B2 | 9/2016 | Fripp et al. | |
| 9,506,324 | B2 | 11/2016 | Kyle et al. | |
| 9,587,486 | B2 | 3/2017 | Walton et al. | |
| 9,816,351 | B2 | 11/2017 | Lirette et al. | |
| 9,920,620 | B2 | 3/2018 | Murphree et al. | |
| 10,024,150 | B2 | 7/2018 | Andreychuk et al. | |
| 10,316,619 | B2 | 6/2019 | de Oliveira et al. | |
| 10,358,914 | B2 | 7/2019 | Roberson et al. | |
| 10,557,329 | B2 | 2/2020 | Gao et al. | |
| 10,718,179 | B2 | 7/2020 | Stair et al. | |
| 10,890,045 | B2 * | 1/2021 | Chenault | E21B 33/1291 |
| 11,280,157 | B2 | 3/2022 | Acosta et al. | |
| 11,293,253 | B2 | 4/2022 | Santoso et al. | |
| 2006/0207765 | A1 | 9/2006 | Hofman | |
| 2007/0261850 | A1 | 11/2007 | Giroux et al. | |
| 2008/0251253 | A1 | 10/2008 | Lumbye | |
| 2009/0071655 | A1 | 3/2009 | Fay | |
| 2009/0151960 | A1 | 6/2009 | Rogers et al. | |
| 2010/0051276 | A1 | 3/2010 | Rogers et al. | |
| 2010/0163253 | A1 | 7/2010 | Caldwell et al. | |
| 2012/0133098 | A1 * | 5/2012 | Farquhar | E21B 33/1216 277/336 |
| 2013/0048290 | A1 | 2/2013 | Howell et al. | |
| 2013/0233570 | A1 | 9/2013 | Acosta et al. | |
| 2013/0233572 | A1 | 9/2013 | Helms et al. | |
| 2015/0027706 | A1 | 1/2015 | Symms | |
| 2015/0184489 | A1 | 7/2015 | Resweber | |
| 2017/0145784 | A1 | 5/2017 | Zhou | |
| 2018/0038192 | A1 | 2/2018 | Stair et al. | |
| 2018/0320473 | A1 | 11/2018 | Xu et al. | |
| 2019/0017366 | A1 | 1/2019 | Alaas et al. | |
| 2019/0249549 | A1 | 8/2019 | Fripp et al. | |
| 2020/0232298 | A1 * | 7/2020 | Deng | E21B 23/06 |
| 2020/0270967 | A1 | 8/2020 | Fong et al. | |
| 2021/0010345 | A1 | 1/2021 | Acosta et al. | |
| 2022/0316296 | A1 | 10/2022 | Urban et al. | |
| 2022/0349272 | A1 | 11/2022 | Patil et al. | |
| 2022/0349273 | A1 | 11/2022 | Dharne et al. | |
| 2023/0203912 | A1 | 6/2023 | Zhong et al. | |

OTHER PUBLICATIONS

Halliburton Catalog titled "Casing Equipment" (2015), entire catalog.

Halliburton Brochure, "CEMENTING ES II Stage Cementer," Feb. 2009.

Halliburton Brochure, "Fidelis Stage Cementer," Sep. 2013.

International Search Report and Written Opinion issued Apr. 5, 2021, in PCT Application No. PCT/US2020/053694.

International Search Report and Written Opinion issued Jun. 20, 2022, in PCT Application No. PCT/US2022/020696.

Halliburton Installation and Operating Instructions, OBSIDIO 9-5/8" Multiple Stage Mechanical Packer Collar, pp. 12, 13, 17 and 18, May 2021.

* cited by examiner

PACKER BACK-UP SHOE

The field relates to packers used in the oil and gas industry. Compression packers provide economical and efficient solutions for wellbore isolation, and in particular for casing to casing isolation. Packers typically have a sealing element that is squeezed axially to expand radially and seal against a previously installed casing. There are situations, however, where the annular space between the previously installed outer casing and the inner casing to be installed in the outer casing is so small that sealing with a conventional tool is difficult, and sometimes not possible. Back-up shoes, also referred to as support shoes are used to restrain the ends of the sealing element, and in tight tolerance scenarios, the design of the back-up shoe can be critical in acquiring a seal.

DESCRIPTION OF AN EMBODIMENT

Figure 1:
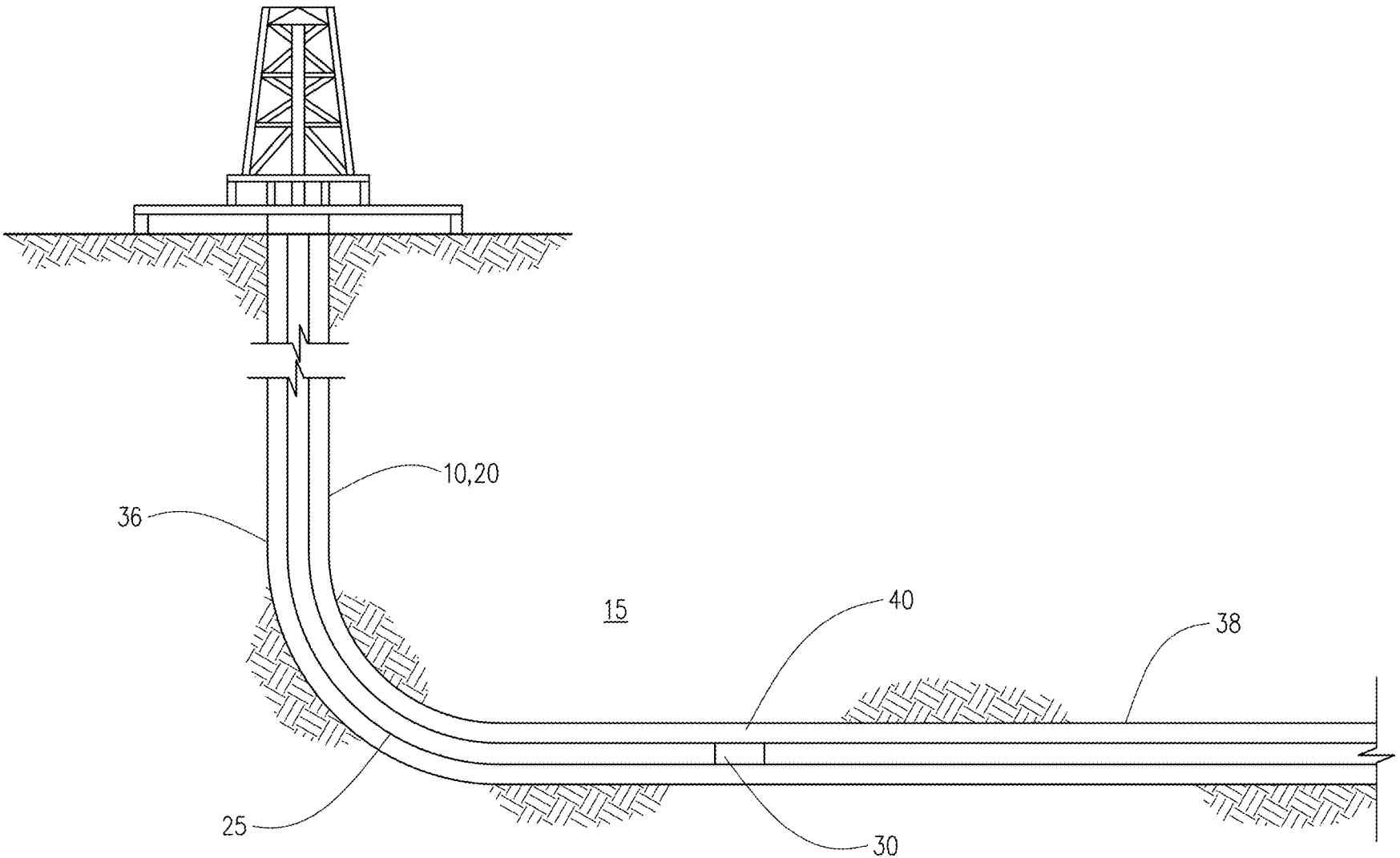
FIG. 1 is a schematic showing a wellbore isolation device in a wellbore.

In the drawings and description that follow, like parts are typically marked throughout the specification and drawings with the same reference numerals, respectively. In addition, similar reference numerals may refer to similar components in different embodiments disclosed herein. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is not intended to limit the invention to the embodiments illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described. It should also be understood that, as used herein, "first," "second," and "third" are assigned arbitrarily and are merely intended to differentiate between two or more components, flow ports, etc., as the case may be, and does not indicate any sequence. Furthermore, it is to be understood that the mere use of the word "first" does not require that there be any "second," and the mere use of the word "second" does not require that there be any "third," etc.

Unless otherwise specified, use of the terms "up," "upper," "upward," "up-hole," "upstream," or other like terms shall be construed as generally toward the surface; likewise, use of "down," "lower," "downward," "down-hole," "downstream," or other like terms shall be construed as generally away from the surface, regardless of the wellbore orientation. Use of any one or more of the foregoing terms shall not be construed as denoting positions along a perfectly vertical axis. A wellbore can include vertical, inclined or horizontal portions, and can be straight or curved.

FIG. 1 shows a wellbore isolation device 30, which in one embodiment is a packer assembly 30 lowered into a wellbore 10 that intersects a subterranean formation 15. In the described embodiment a casing 20 is installed in wellbore 10. Wellbore isolation device 30 may be lowered into wellbore 10 with a conveyance 25 of a type known in the art, for example coiled tubing, jointed pipe, wireline or other known methods. In the embodiment described, conveyance 25 is a casing that may be referred to as an inner casing 25. Packer assembly 30 is movable from the unset position 32 to a set position 34 in wellbore 10. In the described embodiment, wellbore 10 has a vertical portion 36 and a horizontal portion 38, and packer assembly 30 is depicted in horizontal portion 38. Annulus 40 is defined by and between packer assembly 30 and wellbore 10.

Other tools, such as for example a stage cementing tool, may be included in the inner casing string 25 along with packer assembly 30. Any number of different tools may be connected in casing string 25 and used in connection with packer assembly 30. An upper connector 44 may be connected to packer assembly 30 to connect to tubing thereabove and a lower connector 46 to connect to tubing therebelow.

Figure 2:
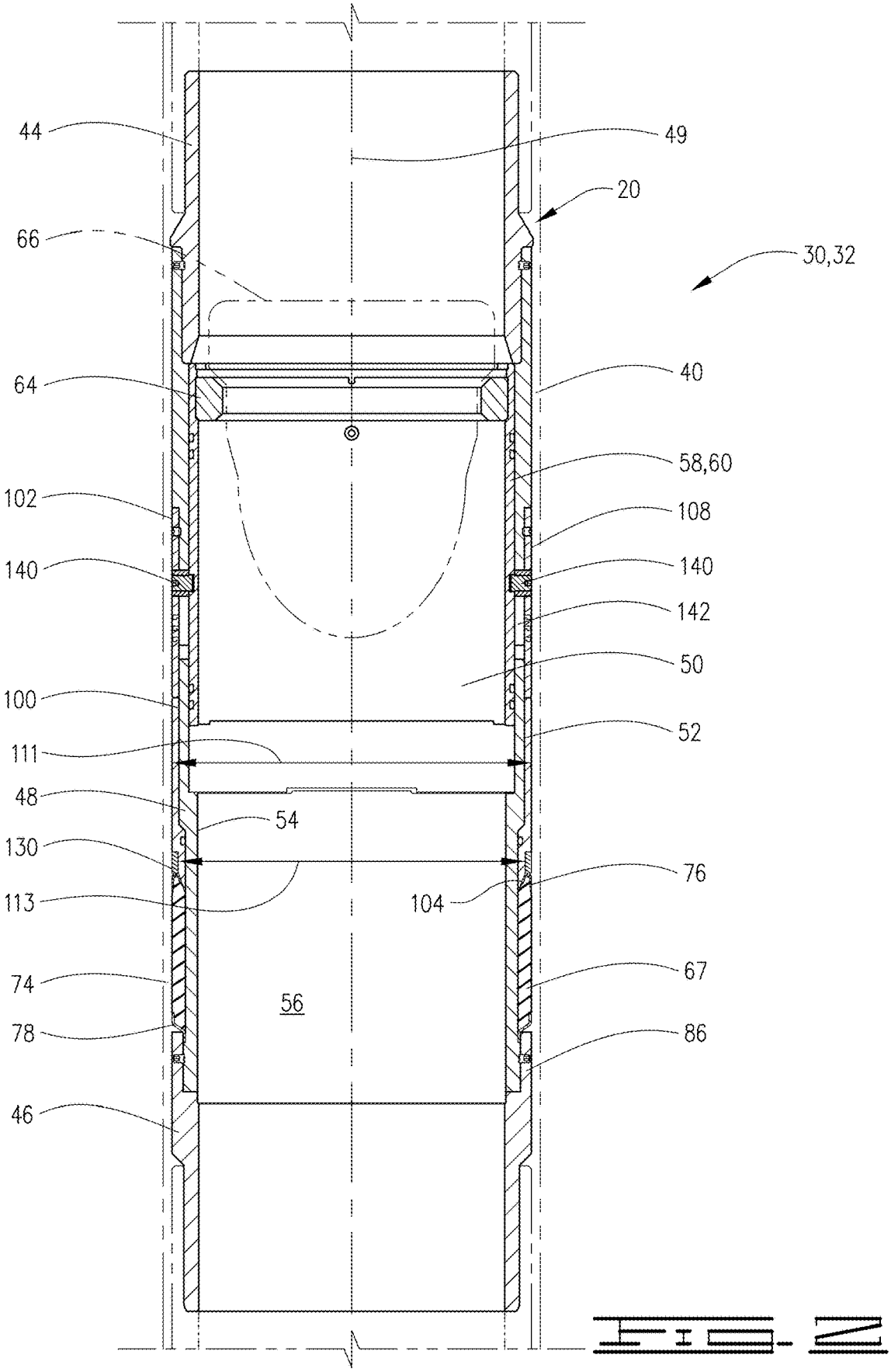
FIG. 2 is a cross section of the wellbore isolation device in a run-in, or unset position.

Packer assembly 30 comprises a packer mandrel 48 that has a longitudinal central axis 49, and defines a central flow passage 50 for the passage of fluids therethrough. Packer mandrel 48 has outer surface 52, inner surface 54 and defines mandrel interior 56. A sliding sleeve 58 is detachably connected in packer mandrel 48, and is shown in a first position 60 in FIG. 2 and a second position 62 in FIG. 3. Packer assembly 30 moves to the set position 34 when sliding sleeve 58 is moved to the second position 62. Sliding sleeve 58 has a plug seat 64 at an upper end thereof for receiving a plug 66 (shown in dashed lines). In some embodiments pressure can be increased after the packer is set, and the sliding sleeve 58 will be detached as a result of the breaking of the drive pins that connect the sliding sleeve 58 to the setting sleeve as further described herein.

A sealing element 67 is disposed about packer mandrel 48. Sealing element 67 has outer surface 68, inner surface 69 and upper and lower ends 70 and 72, respectively. Sealing element 67 expands radially outwardly in the set position 34 of the packer assembly 30 to engage and seal against casing 20. An annular space 74 is defined between sealing element 67 and casing 20 in the unset position 32 of the packer assembly 30. An upper support shoe 76 is positioned at the upper end 70 of sealing element 67 and a lower support shoe 78 is positioned at the lower end 72 of sealing element 67. Upper and lower support shoes 76 and 78 in some embodiments are comprised of a ductile, deformable material, for example a ductile steel with a 35,000 psi yield strength. It is understood that other deformable materials may be used.

Figure 3:
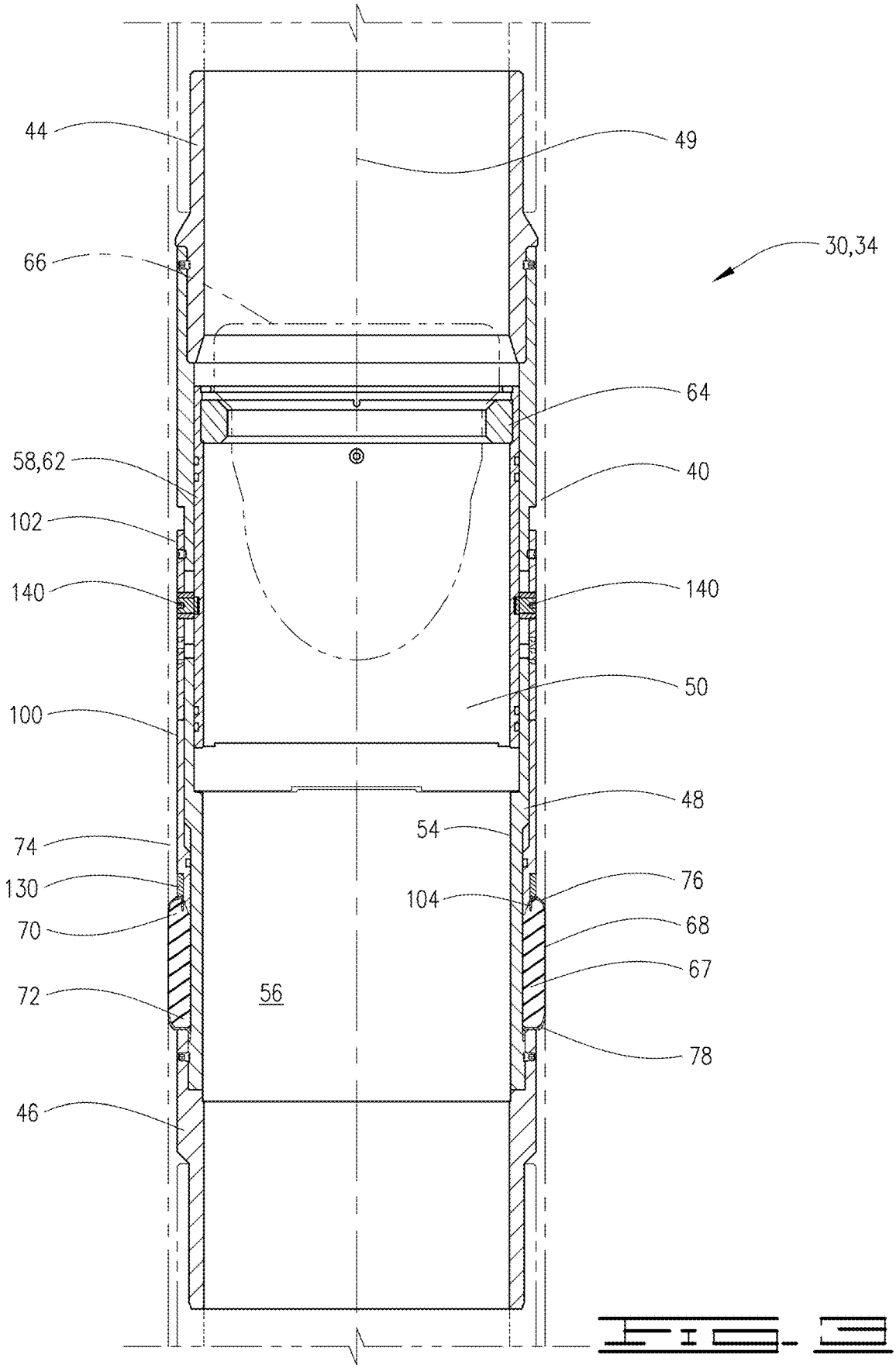
FIG. 3 is a cross section of the wellbore isolation device in set position.
Figure 4:
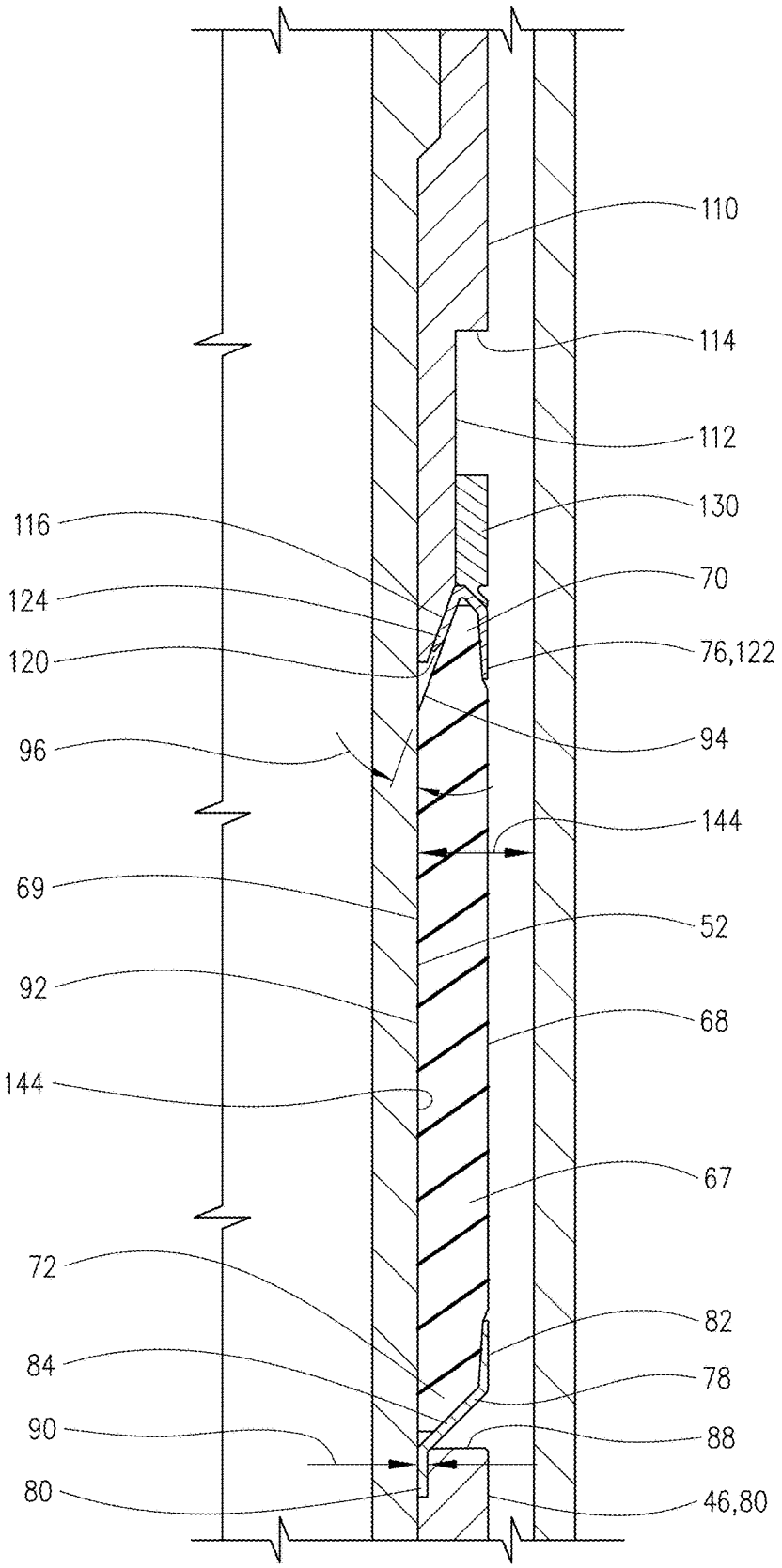
FIG. 4 is a close-up cross-sectional view of a portion of the wellbore isolation device in the unset position.
Figure 5:
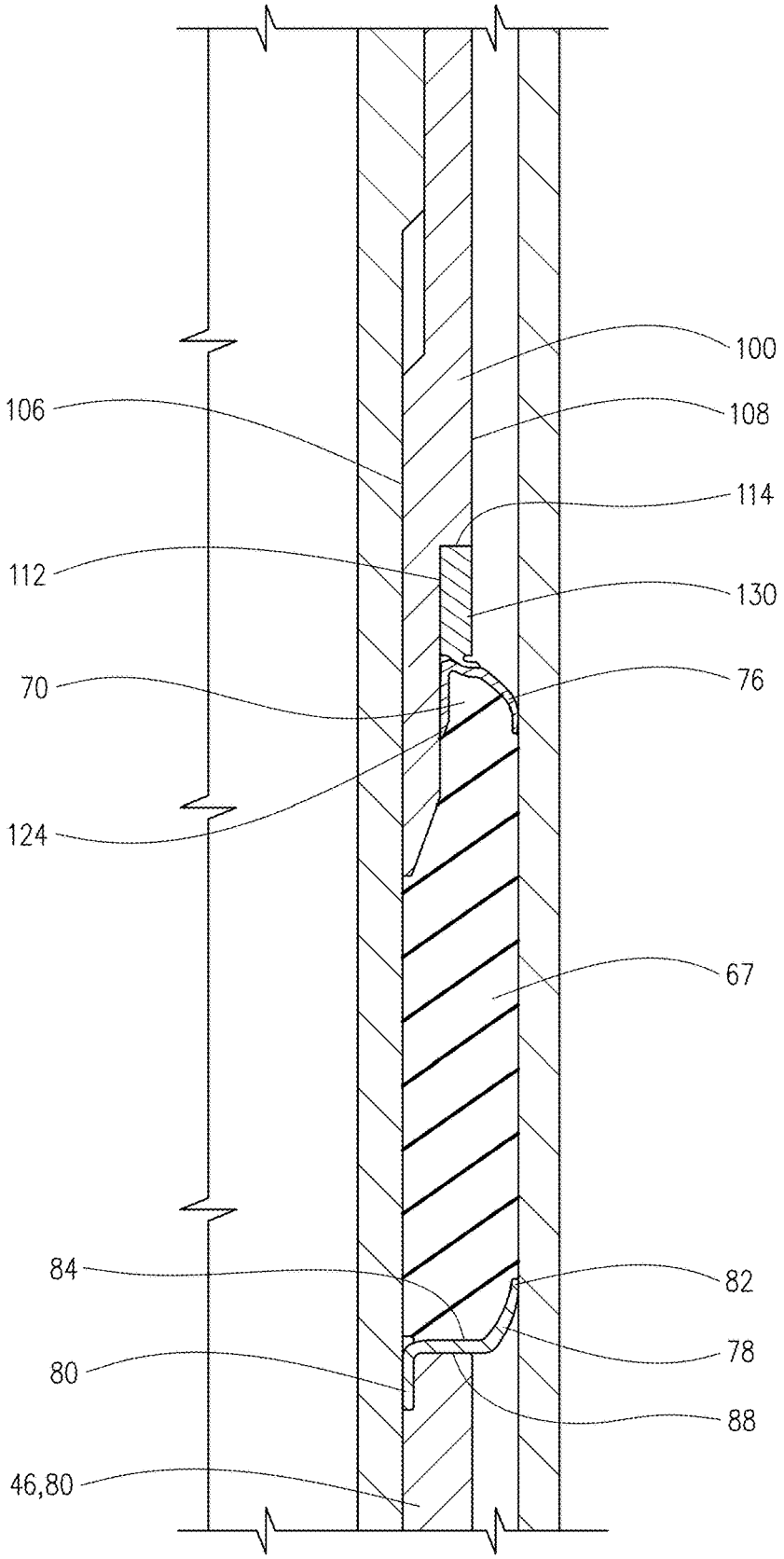
FIG. 5 is a close-up cross-sectional view of a portion of the wellbore isolation device in the set position.
Figure 6:
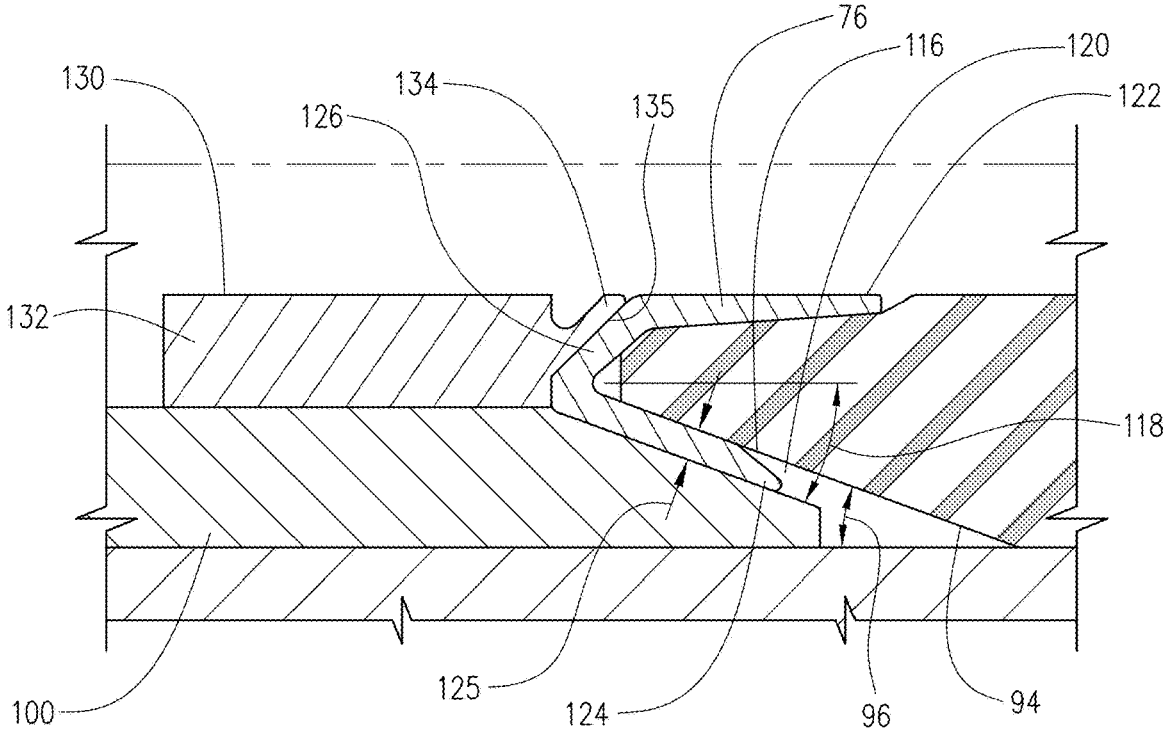
FIGS. 6 and 7 are close up cross-sectional views of alternative embodiments of cover sleeves.

Lower support shoe 78 has a leg 80, an arm 82 and a connecting section 84. Lower connector 46 acts as a cover sleeve 86 that defines a shoulder 88. Leg 80 is received within a gap 90 between cover sleeve 86 and packer mandrel 48. Arm 82 extends axially over a portion of sealing element 67. When packer assembly 30 is moved to the set position 34, shoulder 88 will abut lower end 72 of sealing element 67, and lower support shoe 78 will deform as shown in FIG. 3. Lower support shoe 78 acts as an anti-extrusion element when packer assembly 30 moves to the set position 34.

Inner surface 69 of sealing element 67 defines a generally cylindrical portion 92 that engages outer surface 52 of packer mandrel 48, and defines a ramped surface 94 that slopes radially outwardly and upwardly away from inner surface 69. Ramped surface 94 on sealing element 67 is at an angle 96 of about 10° to 45° from inner surface 69, and from the longitudinal central axis 49 of packer mandrel 48.

A setting sleeve 100 has upper end 102, lower end 104, inner surface 106 and outer surface 108. Outer surface 108 defines first and second generally cylindrical portions 110 and 112 with first and second outer diameters 111 and 113 respectively. A downward facing shoulder 114 is defined by first and second cylindrical portions 110 and 112. Setting sleeve 100 has a ramped or sloped surface 116 that slopes radially inwardly from outer surface 108 on second cylindrical portion 112. Ramped surface 116 extends longitudinally and radially inwardly from second cylindrical portion 112, and defines an angle 118 of about 10° to 45° from the surface of the second cylindrical portion 112, which is the vertical as depicted in the figures. It is understood that the suggested angles represent the typical range and may change depending on the design specifics. Second cylindrical portion 112 is parallel to longitudinal central axis 49, such that ramped surface 116 is also at angle 118 from longitudinal central axis 49. Angle 118 is in the described embodiment about the same as angle 96, so that ramped surface 94 of sealing element 67 and ramped surface 116 of setting sleeve 100 are generally parallel. Ramped surface 94 extends beneath sealing element 67, and a space 120 is defined by and between ramped surfaces 94 and 116.

Upper support shoe 76 envelops upper end 70 of sealing element 67. In other words, upper support shoe 76 extends from the outer surface 68 of sealing element 67, around the upper end of sealing element 67 and beneath inner surface 69. In the described embodiment, upper support shoe 76 comprises an arm 122 that extends axially over sealing element 67 and a shoe leg 124 that extends between sealing element 67 and setting sleeve 100. Shoe leg 124 has a thickness 125 and is positioned in space 120 between ramped surfaces 94 and 116. A connecting joint 126 connects support shoe arm 122 with support shoe leg 124. In the described embodiment shoe leg 124 is generally parallel to ramped surfaces 94 and 116. Upper support shoe 76 is slidable relative to setting sleeve 100. In the described embodiment shoe leg 124 engages and slides along ramped surface 94 when the packer assembly 30 moves from the unset to the set position. The upper support shoe 76 thus simultaneously deploys and slides along the surface of the setting sleeve 100. In other words, the upper support shoe 76 deforms and slides along the surface of the setting sleeve 100 at the same time.

Figure 7:
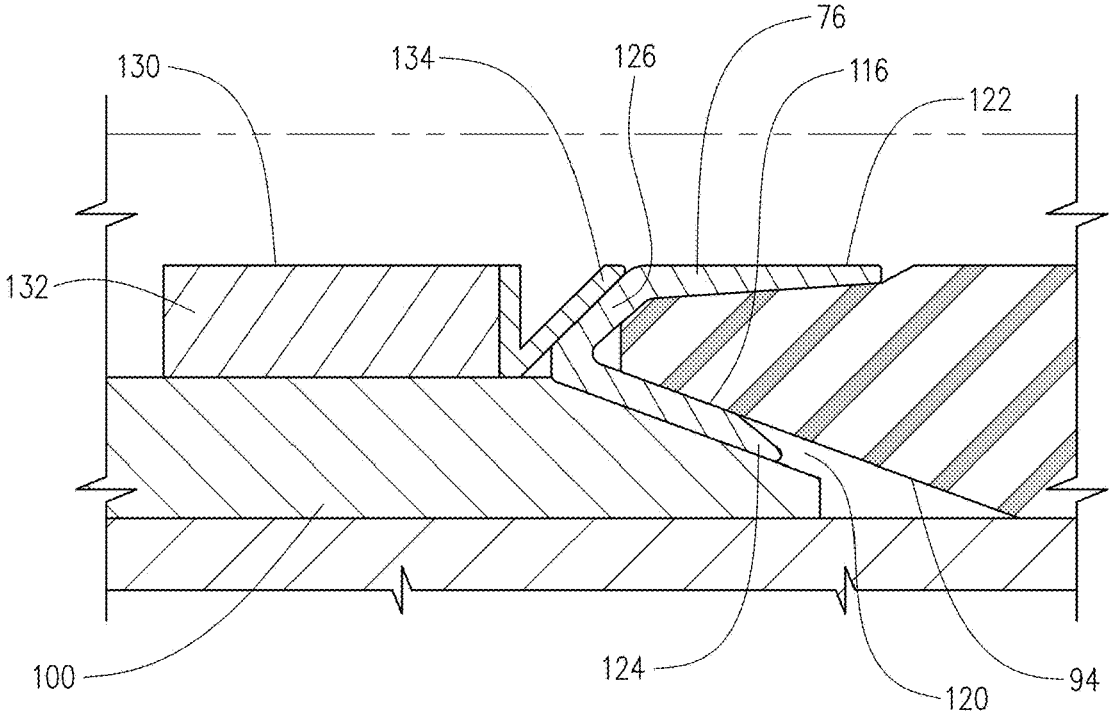

A cover sleeve 130 is slidably disposed about setting sleeve 100. Cover sleeve 130 comprises a cover sleeve body 132 and a cover sleeve interface 134. Cover sleeve interface 134 may be integrally formed with cover sleeve body 132 or may be a separate interface as depicted in FIG. 7 affixed to cover sleeve body 132 with adhesives or other means known in the art. Cover sleeve interface 134 is configured and oriented to engage upper support shoe 76 and has a surface 135 to mate with the outer surface of upper support shoe 76. Upper support shoe 76 and cover sleeve 130 thus have what may be described as mating outer surfaces. Cover sleeve interface 134 is a flexible interface, and will flex and change orientation relative to cover sleeve body 132. Although described herein as separate components, the cover sleeve 130 may be fixed to support shoe 76, or may be integrally formed therewith. In addition, it will be understood that a support shoe like upper support shoe 76 may be used in place of the lower support shoe 78 that is described herein.

Sliding sleeve 58 is connected to setting sleeve 100 with shearable drive pins 140 that extend through slots 142 in packer mandrel 48. In operation, packer assembly 30 will move from the unset to the set position when plug 66 engages plug seat 64 and fluid pressure is applied to move sliding sleeve 58 downwardly which urges setting sleeve 100 downwardly on packer mandrel 48. Upper support shoe 76 is slidably engaged with setting sleeve 100, so that as setting sleeve 100 moves down, upper support shoe 76 slides along and climbs ramped surface 116. Sealing element 67 likewise climbs ramped surface 116. As upper support shoe 76 moves relative to setting sleeve 100, it deforms as it moves. Shoe leg 124 bends so that it will be parallel to and will slide along second cylindrical portion 112 of setting sleeve 100. The thickness 125 of support shoe leg 124 fills the space 120 and reduces the expansion gap between setting sleeve 100 and casing 20. In other words, the sealing element 67 is not required to expand to fill the entire gap 144 between the outer surface of setting sleeve 100 and casing 20, since shoe leg 124 fills a portion of the gap 144. Downward facing shoulder 114 on setting sleeve 100 will engage cover sleeve body 132 so that sealing element 67 is expanded to the set position in which it engages casing 20. Upper support shoe 76 will deform and sealing element 67 will be clamped between support shoe arm 122 and support shoe leg 124. Because the sealing element 67 is clamped by support shoe arm 122 and support shoe leg 124, upper support shoe 76 provides a robust seal and anti-extrusion mechanism. If desired, once packer assembly 30 is set, pressure can be increased to break drive pins 140 and allow sliding sleeve 58 to move to a third position in the packer mandrel 48.

Embodiments include:

Embodiment 1. A packer assembly comprising a packer mandrel and a sealing element disposed about the packer mandrel. A setting sleeve comprising a generally cylindrical portion with a sloped ramp extending longitudinally and radially inwardly therefrom is disposed about the packer mandrel and is movable longitudinally thereon to move the packer assembly from an unset to a set position in which the sealing element expands to engage a wellbore casing in which the packer assembly is placed. A support shoe comprises a support shoe arm extending longitudinally over an outer surface of the sealing element and a support shoe leg connected to the support shoe arm. The support shoe leg is engaged with the sloped ramp and positioned beneath an inner surface of the sealing element in a space between the sealing element and the setting sleeve.

Embodiment 2. The packer assembly of embodiment 1, wherein the support shoe leg is parallel to the sloped ramp in the unset position of the packer assembly.

Embodiment 3. The packer assembly of any of embodiments 1-2, a surface of the support shoe leg being slidably engaged with an outer surface of the sloped ramp.

Embodiment 4. The packer assembly of any of embodiments 1-3, wherein the support shoe leg slides from the sloped ramp to the cylindrical portion of the setting sleeve when the packer assembly moves from the unset to the set position.

Embodiment 5. The packer assembly of any of embodiments 1-4, wherein an upper end of the sealing element is clamped between the support shoe leg and support shoe arm in the unset and set positions of the packer assembly.

Embodiment 6. The packer assembly of either of embodiments 4 or 5, wherein the support shoe is deformed as it slides along the outer surface of the setting sleeve such that the support shoe leg is parallel to the outer surface of the cylindrical portion of the setting sleeve in the set position of the packer assembly.

Embodiment 7. The packer assembly of any of embodiments 1-6, further comprising a cover sleeve disposed about the setting sleeve, the cover sleeve having a flexible interface engaging the support shoe.

Embodiment 8. A support apparatus for a sealing element of a packer assembly comprising a support shoe that a support shoe arm extending longitudinally over an outer surface of the sealing element; a support shoe leg extending beneath the sealing element and a connecting portion connecting the support shoe arm and the support shoe leg, the support shoe enveloping an upper end of the sealing element. The support apparatus comprises a cover sleeve comprising a cover sleeve body and a flexible cover sleeve interface extending from the cover sleeve body, the flexible cover sleeve interface being engaged with the connecting portion of the support shoe.

Embodiment 9. The support apparatus of embodiment 8, the cover sleeve being fixed to the support shoe at the engagement of the cover sleeve interface and the support shoe.

Embodiment 10. The support apparatus of either of embodiments 8 or 9, the cover sleeve and the support shoe being integrally formed.

Embodiment 11. A packer assembly comprising: a packer mandrel, the sealing element being disposed about the packer mandrel; the support apparatus of any of embodiments 8-10; and a setting sleeve disposed about the packer mandrel and movable from a first to a second position on the packer mandrel to move the packer assembly from an unset to a set position in which the sealing element expands to engage a casing in which the packer assembly is placed, the setting sleeve comprising a generally cylindrical portion with a sloped ramp extending longitudinally and radially inwardly therefrom, the support shoe leg being positioned in a gap between the sloped ramp of the setting sleeve and the sealing element.

Embodiment 12. The packer assembly of embodiment 10, wherein the support shoe leg is slidably engaged with an outer surface of the setting sleeve, and wherein an angle of the support shoe leg relative to a longitudinal axis of the packer mandrel changes as the setting sleeve moves from the first to the second position.

Embodiment 13. The packer assembly of either of embodiments 11 or 12, wherein the support shoe simultaneously deploys and slides along the sloped ramp on to the cylindrical portion of the setting sleeve as the packer assembly moves from the unset to the set position.

Embodiment 14. The packer assembly of either of embodiments 10 and 11, wherein the support shoe leg is parallel to an outer surface of the setting sleeve in the unset and set positions of the packer assembly.

Embodiment 15. The packer element of any of embodiments 11-14, wherein the support shoe clamps an end of the sealing element in the set and unset positions of the packer assembly.

Embodiment 16. A packer assembly comprising a packer mandrel; a sealing element disposed about the packer mandrel; a setting sleeve disposed about the packer mandrel and slidable thereon from a first position to a second position in which the sealing element is radially expanded to engage a casing in which the packer assembly is placed; and a support shoe extending from an outer surface of the sealing element around an end of the sealing element and into a gap between the sealing element and the setting sleeve, wherein the support shoe simultaneously slides on the setting sleeve and deploys as the sealing element is radially expanded.

Embodiment 17. The packer assembly of embodiment 16 further comprising a cover sleeve disposed about the setting sleeve, the cover sleeve having a flexible interface engaging the support shoe.

Embodiment 18. The packer assembly of embodiment 17, wherein the flexible interface deforms when the setting sleeve moves from the first to the second position.

Embodiment 19. The packer assembly of any of embodiments 17-18, the setting sleeve comprising a cylindrical portion and a sloped ramp extending longitudinally and radially inwardly therefrom, the gap between the setting sleeve and the sealing element being defined between the sloped ramp of the setting sleeve and the sealing element, the support shoe having a support shoe leg positioned in the gap between the sealing element and the sloped ramp.

Embodiment 20. The packer assembly of embodiment 19, wherein the support shoe leg is parallel to an outer surface of the sloped ramp in the first position of the setting sleeve and is parallel to an outer surface of the cylindrical portion of the setting sleeve when the setting sleeve is in the second position.

Although various embodiments have been shown and described, the disclosure is not limited to such embodiments and will be understood to include all modifications and variations as would be apparent to one skilled in the art. Therefore, it should be understood that the disclosure is not intended to be limited to the particular forms disclosed; rather, the intention is to cover all modifications, equivalents, and alternatives falling within the spirit and scope of the disclosure as defined by the appended claims.

What is claimed is:

1. A packer assembly comprising:

a packer mandrel;

a sealing element disposed about the packer mandrel;

a setting sleeve comprising a generally cylindrical portion with a sloped ramp extending longitudinally and radially inwardly therefrom disposed about the packer mandrel and movable longitudinally thereon to move the packer assembly from an unset to a set position in which the sealing element expands to engage a wellbore casing in which the packer assembly is placed; and a support shoe comprising:

a support shoe arm extending longitudinally over an outer surface of the sealing element; and a support shoe leg connected to the support shoe arm, the support shoe leg being engaged with the sloped ramp and positioned in a space between the sloped ramp of the setting sleeve and the sealing element, wherein the support shoe leg rotates radially outwardly when the packer assembly moves from the unset to the set position.

2. The packer assembly of claim 1, wherein the support shoe leg is parallel to the sloped ramp in the unset position of the packer assembly, and is parallel to a surface of the cylindrical portion of the settling sleeve in the set position of the packer assembly.

3. The packer assembly of claim 1, a surface of the support shoe leg being slidably engaged with an outer surface of the sloped ramp.

4. The packer assembly of claim 3, wherein the support shoe leg slides from the sloped ramp to the cylindrical portion of the setting sleeve when the packer assembly moves from the unset to the set position.

5. The packer assembly of claim 4, wherein an upper end of the sealing element is clamped between the support shoe leg and support shoe arm in the unset and set positions of the packer assembly.

6. The packer assembly of claim 4, wherein the support shoe is deformed as it slides along the outer surface of the setting sleeve such that the support shoe leg is parallel to the outer surface of the cylindrical portion of the setting sleeve in the set position of the packer assembly.

7. The packer assembly of claim 1, further comprising a cover sleeve disposed about the setting sleeve, the cover sleeve having a flexible interface engaging the support shoe.

8. A packer assembly comprising:

a support shoe comprising:

a support shoe arm extending longitudinally over an outer surface of a sealing element of the packer assembly;

a support shoe leg extending beneath the sealing element; and a connecting portion connecting the support shoe arm and the support shoe leg, the support shoe enveloping an upper end of the sealing element;

a discrete cover sleeve comprising a cover sleeve body and a flexible cover sleeve interface extending from the cover sleeve body, the flexible cover sleeve interface being engaged with the connecting portion of the support shoe, the cover sleeve being positioned to apply an axially directed force to the support shoe;

a packer mandrel, the sealing element being disposed about the packer mandrel; and a setting sleeve disposed about the packer mandrel and movable from a first to a second position on the packer mandrel to move the packer assembly from an unset to a set position in which the sealing element expands to engage a casing in which the packer assembly is placed, the setting sleeve comprising a generally cylindrical portion with a sloped ramp extending longitudinally and radially inwardly therefrom, the support shoe leg being positioned in a gap between the sloped ramp of the setting sleeve and the sealing element.

9. The packer assembly of claim 8, wherein the support shoe leg is slidably engaged with an outer surface of the setting sleeve, and wherein an angle of the support shoe leg relative to a longitudinal axis of the packer mandrel changes as the setting sleeve moves from the first to the second position.

10. The packer assembly of claim 8, wherein the support shoe simultaneously deploys and slides along the sloped ramp on to the cylindrical portion of the setting sleeve as the packer assembly moves from the unset to the set position.

11. The packer assembly of claim 8, wherein the support shoe leg is parallel to an outer surface of sloped ramp of the setting sleeve in the unset position of the packer assembly and is parallel to an outer surface of cylindrical portion of the setting sleeve in the set position of the packer assembly.

12. The packer assembly of claim 8, wherein the support shoe clamps an end of the sealing element in the set and unset positions of the packer assembly.

13. A packer assembly comprising:

a packer mandrel;

a sealing element disposed about the packer mandrel;

a setting sleeve disposed about the packer mandrel and slidable thereon from a first position to a second position in which the sealing element is radially expanded to engage a casing in which the packer assembly is placed, the setting sleeve comprising a cylindrical portion and a sloped ramp extending longitudinally and radially inwardly therefrom; and a support shoe extending from an outer surface of the sealing element around an end of the sealing element and into a gap between the sealing element and the sloped ramp of the setting sleeve, the support shoe having a support shoe leg that extends into the gap between the sealing element and the sloped ramp of the setting sleeve, wherein the support shoe simultaneously slides on the setting sleeve and deploys as the sealing element is radially expanded.

14. The packer assembly of claim 13, further comprising a cover sleeve disposed about the setting sleeve, the cover sleeve having a flexible interface engaging the support shoe.

15. The packer assembly of claim 14, wherein the flexible interface deforms when the setting sleeve moves from the first to the second position.

16. The packer assembly of claim 13, wherein the support shoe leg is parallel to an outer surface of the sloped ramp in the first position of the setting sleeve and is parallel to an outer surface of the cylindrical portion of the setting sleeve when the setting sleeve is in the second position.

* * * * *